US005319279A

United States Patent [19]

Watanabe et al.

[11] Patent Number: 5,319,279

[45] Date of Patent: Jun. 7, 1994

[54] ARRAY OF FIELD EMISSION CATHODES

[75] Inventors: Hidetoshi Watanabe, Ibaragi; Toshio Ohoshi, Tokyo, both of Japan

[73] Assignee: Sony Corporation, Tokyo, Japan

[21] Appl. No.: 850,888

[22] Filed: Mar. 13, 1992

[30] Foreign Application Priority Data

Mar. 13, 1991 [JP] Japan ..... 3-048423
Mar. 21, 1991 [JP] Japan ..... 3-057270

[51] Int. Cl.[5] ..... H01J 1/02; H01J 1/30
[52] U.S. Cl. ..... 313/309; 313/351
[58] Field of Search ..... 313/309, 336, 351

[56] References Cited

U.S. PATENT DOCUMENTS 4,721,885 1/1988 Brodie ..... 313/309 X
5,038,070 8/1991 Bardai et al. ..... 313/309
5,066,883 11/1991 Yoshioka et al. ..... 313/309

*Primary Examiner*—Sandra L. O'Shea
*Attorney, Agent, or Firm*—Hill, Steadman & Simpson

[57] ABSTRACT

Disclosed herein is an array of field emission cathodes of the type, in which each element is made up of a substrate 1 (which serves as a first electrode 1), an insulating layer 2 in which is formed a cavity 6, a cathode 9 formed in the cavity 6 and on the first electrode 1, and a second electrode 3 formed on the insulating layer 2, and the second electrode is coated with a protective metal layer having good conductivity and corrosion resistance. The record electrode (the gate electrode) protected from oxidation permits stable electron emission. Also disclosed herein is an array of field emission cathodes in which each element is made up of a first electrode 11 to apply voltage to a plurality of cathodes 9, a resistance layer 12, an insulating layer 2, and a second electrode 3 which are formed on top of the other, a cavity 6 formed in the second electrode 3 and insulating layer 2, and a cathode 9 formed in the cavity 6 and on the resistance layer 12, with the first electrode 11 having a void under the cathode 9. This structure prevents short circuits between the cathode and the gate electrode, which contributes to high yields and long life.

2 Claims, 9 Drawing Sheets

ARRAY OF FIELD EMISSION CATHODES

BACKGROUND OF THE INVENTION

1. Field of the Invention

The present invention relates to an array of field emission cathodes.

2. Description of the Prior Art

There is an array of minute field emission cathodes, each element having a cathode of several microns in size. It is known as the Spindt-type field emission cathode, which will be explained with reference to FIG. 11.

Referring to FIG. 11, there is shown an electrically conductive substrate 1 made of silicon or the like, which serves as a first electrode. On the substrate 1 is a sharply pointed conical cathode 9 made of such a metal as tungsten and molybdenum, which has a high melting point and a low work function. Around the conical cathode 9 is an insulating layer 2 made of $SiO_2$ or the like. On the insulating layer 2 is a second electrode 3 (as a gate electrode or a counter electrode of the cathode 9) made of a high-melting metal such as molybdenum, tungsten, and chromium. There is an alternative structure in which a first electrode 11 is formed separately on a substrate 10 as shown in FIG. 12.

An array of field emission cathodes mentioned above is produced by the process explained below with reference to FIG. 13. As shown in FIG. 13A, the process starts with forming consecutively on a silicon substrate 1 an insulating layer 2 of $SiO_2$ (1–1.5 μm thick) by CVD (chemical vapor deposition), a metal layer 3*a* of a high-melting metal such as molybdenum and tungsten (in thickness of the order of thousands of angstroms, say 4000 Å) by vacuum deposition or sputtering, and a resist 4 by coating.

As shown in FIG. 13B, the resist 4 is subsequently exposed and developed by photolithography to form an opening 5*a*, about 1 μm in diameter (indicated by w). The metal layer 3*a* undergoes anisotropic etching through the opening 5*a* by RIE (reactive ion etching) to form an opening 5 of the same diameter as the opening 5*a*. Thus there is formed a gate electrode 23 from the metal layer 3*a*. The insulating layer 2 undergoes over-etching through the opening 5 to form a cavity 6. This over-etching is carried out such that the periphery of the opening 5 of the gate electrode 23 projects from the inside wall of the cavity 6 in the insulating layer 2.

As shown in FIG. 13C, an intermediate layer 7 is formed on the gate electrode 23 by oblique deposition in the direction of arrow a (at such an angle as to avoid deposition in the opening 5 and cavity 6), with the substrate 1 turning. This intermediate layer 7 is made of aluminum or nickel, which can be removed later by etching. The angle of oblique etching should be 5°–20° with respect to the surface of the substrate 1. The oblique deposition takes place such that the intermediate layer 7 has an opening which is smaller than the opening 5.

As shown in FIG. 13D, a material layer 8 of molybdenum or the like is deposited over the entire surface by vertical deposition so as to form a conical cathode 9 in the cavity 6. (Since the opening in the intermediate layer 7 is smaller than the opening 5 on account of the oblique deposition, the opening of the material layer 8 becomes smaller as the deposition proceeds. This makes the cathode 9 being formed on the substrate by deposition through the opening 5 become tapered off with time.)

Finally, the material layer 8 is removed by lift-off as the intermediate layer 7 is removed by etching with a sodium hydroxide solution which dissolves the intermediate layer 7 alone. Thus there is obtained a field emission cathode as shown in FIG. 11.

The thus formed field emission cathode emits electrons upon application of a voltage of about $10^6$ V/cm or above across the cathode 9 and the gate electrode (or the second electrode 3), with the cathode 9 unheated. This kind of minute field emission cathode can operate at a comparatively low voltage, with the gate voltage being of the order of tens to hundreds of volts. An array of hundreds of millions of such field emission cathodes arranged at intervals of about 10 μm may be used as electron guns for a thin display that operates at a low voltage (or with a low electric power).

A disadvantage of the foregoing field emission cathodes is that the gate electrode 23 made of a high-melting metal such as molybdenum, tungsten, and chromium is liable to oxidation, which lowers its conductivity and hence leads to unstable electron emission.

Another disadvantage of the foregoing field emission cathodes is that the intermediate layer 7 made of aluminum or nickel is not completely removed from the gate electrode 23 by wet etching, but some residues (which are electrically conductive) remain undissolved. Residues remaining on the gate electrode 23 may adversely affect the electron emission characteristics and cut-off characteristics, or short-circuit the gate electrode 23 and the cathode 9. This leads to an increase in defective products and a decrease in yields.

The present inventors had previously proposed a process for producing an array of field emission cathodes without using the oblique deposition. (See Japanese Patent Laid-open No. 160740/1981.) This process consists of covering the obverse of a substrate of silicon single crystal with a masking layer having a patterned opening, performing crystallographic etching through the opening, thereby forming a conical hole, forming an electrode layer on the inside of the conical hole by vacuum deposition or sputtering of tungsten or the like, filling the conical hole with an insulating reinforcement material, performing ordinary etching (or non-crystallographic etching) on the reverse of the substrate (so that the apex of the electrode layer formed in the conical hole is exposed), thereby forming the tip of the cathode, forming an insulating layer so as to embed the cathode therein, and covering the insulating layer with a conducting layer. Finally, the conducting layer and insulating layer undergo etching as shown in FIGS. 13A and 13B, so that the cathode is exposed.

This process offers an advantage that the conical cathode invariably has an acute vertical angle and there are no problems involving the residues of the intermediate layer 7. However, there still remains the problem associated with the oxidation of the gate electrode which leads to a decrease in conductivity. The effect of oxidation is serious because the gate electrode is very thin (thousands of angstrom). The oxidized gate electrode will not operate satisfactorily with a gate voltage of the order of tens to hundreds of volts.

There is an alternative structure as shown in FIG. 15. It is characterized by a thin resistance layer 12 of silicon interposed between the first electrode 11 and the cathode 9. The resistance layer 12 has a thickness from several angstroms to several microns and also has a resistance of the order of hundreds to millions of Ω.cm. The resistance layer 12 permits each cathode 9 to emit electrons at a constant rate. This will be described in more detail with reference to FIGS. 14 and 15 which are schematic enlarged sectional views showing an array of field emission cathodes.

Referring to FIG. 14, there are shown a plurality of cathodes $9_1$ and $9_2$ formed directly on the first electrode 11, which is not provided with the resistance layer 12. The electron flow is indicated by arrows e. In actual mass production of flat displays as mentioned above, the electrodes $9_1$ and $9_2$ will vary slightly in size and shape as shown in FIG. 14. This variation leads to the fluctuation of the electric field strength required for electron emission, which in turn causes the emissivity to fluctuate. For example, there would be an instance where the cathode $9_1$ emits electrons at 50 V, while the cathode $9_2$ needs 100 V for electron emission. There would be another instance where the cathode $9_1$ alone emits electrons at 50 V, while the cathode $9_2$ does not work at 50 V. There would be another instance where the cathode $9_2$ emits electrons at 100 V, while the cathode $9_1$ is broken at 100 V.

If a flat display is made up of field emission cathodes which are not uniform in shape as mentioned above, the screen will vary in brightness from one spot to another on account of the uneven electron emission. Moreover, the lack of uniformity causes some elements to be broken, which shortens the life of the flat display.

The foregoing problem does not arise from the field emission cathode as shown in FIG. 15. It has a resistance layer 12 interposed between the cathode and the first electrode 11. The resistance layer 12 gives rise to resistance $R_1$ and $R_2$ between the electrode 11 and the cathodes $9_1$ and $9_2$, respectively. It is assumed that when a voltage $V_0$ is applied, the current $i_1$ flowing to the cathode $9_1$ is larger than the current $i_2$ flowing to the cathode $9_2$ so that the cathode $9_1$ emits more electrons than the cathode $9_2$. In this situation, the cathode $9_1$ experiences voltage drop due to the resistance $R_1$, and hence the voltage applied to the cathode $9_1$ becomes $$V_1 = V_0 - \Delta V_1 = V_0 - R_1 i_1$$

Similarly, the voltage applied to the cathode $9_2$ becomes $$V_2 = V_0 - \Delta V_2 = V_0 - R_2 i_2$$

and $V_1$ becomes smaller than $V_2$. A moment later, the cathode $9_1$ emits less electrons than the cathode $9_2$. As the result, the emission of electrons from each cathode levels out. In this way, it is possible to keep uniform the screen of the flat display.

In addition, the resistance layer 12 prevents current from flowing freely from the tip of the cathode to the second electrode even when an electrically conductive minute particle of dust gets in between them, as shown in FIG. 16 which is a schematic enlarged sectional view. This situation permits adjacent cathodes to continue emitting electrons, with a prescribed voltage applied across the cathode and the second electrode.

However, the resistance layer 12 will not function properly if it has a defect such as a pinhole 20 as shown in FIG. 17, which is a schematic enlarged sectional view. In this case, the pinhole 20 connects the cathode 9 to the first electrode 11 and hence a short circuit takes place between the tip of the cathode 9 and the second electrode 3 when an electrically conductive minute particle of dust gets in between them. This situation prevents adjacent cathodes from emitting electrons.

The foregoing defect is liable to occur in a display composed of hundreds of millions of cathodes. In addition, short circuits by dust prevent a plurality of cathodes from emitting electrons and hence reduce the life of the display.

SUMMARY OF THE INVENTION

It is an object of the present invention to provide an array of field emission cathodes of the type, in which each element is made up of a substrate 1 (which serves as a first electrode 1), an insulating layer 2 in which is formed a cavity 6, a cathode 9 formed in the cavity 6 and on the first electrode 1, and a second electrode 3 formed on the insulating layer 2, characterized in that the second electrode is coated with a protective metal layer having good conductivity and corrosion resistance.

According to the present invention, the second electrode 3 (or the gate electrode) is coated with a highly conductive, corrosion resistant metal layer 13, as mentioned above. The metal layer 13 protects the second electrode 3 from oxidation and hence prevents it from increasing in resistance. This permits stable electron emission by application of a prescribed low voltage.

An embodiment of the present invention is shown in FIG. 6 which is a schematic enlarged sectional view. Each element is made up of a first electrode 11 to apply voltage to a plurality of cathodes 9, a resistance layer 12, an insulating layer 2, and a second electrode 3 which are formed on top of the other, a cavity 6 formed in the second electrode 3 and insulating layer 2, and a cathode 9 formed in the cavity 6 and on the resistance layer 12, with the first electrode 11 having a void under the cathode 9.

According to the present invention, each element of the field emission cathodes is characterized by that the first electrode 11 has a void under the cathode 9. This structure offers an advantage that no short circuits take place between the first electrode 11 and the second electrode 3 even when an electrically conductive particle 14 of dust gets in between the tip of the cathode 9 and the second electrode 3, as shown in FIG. 8, which is a schematic enlarged sectional view.

The same effect as mentioned just above is produced even if the resistance layer 12 has a pinhole 20 as shown in FIG. 9, which is a schematic enlarged sectional view.

The field emission cathodes constructed as mentioned above may be arranged in great numbers to form long-life flat displays in high yields, because, owing to the resistance layer 12, the cathodes 9 emit electrons uniformly and most of the cathodes 9 function normally even when part of them are affected by electrically conductive particles of dust 14.

DETAILED DESCRIPTION OF THE INVENTION

EXAMPLE 1

Figure 1:
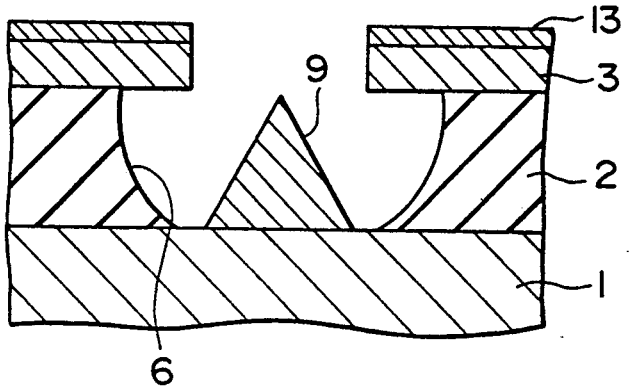
FIG. 1 is a schematic enlarged sectional view showing an embodiment of an array of field emission cathodes pertaining to the present invention.

An embodiment of the present invention is explained with reference to FIG. 1, in which there is shown a substrate 1 (as a first electrode) which is made of silicon or the like. On the substrate 1 is a sharply pointed conical cathode 9 made of such a metal as tungsten and molybdenum, which has a high melting point and a low work function. Around the conical cathode 9 is an insulating layer 2 of $SiO_2$ or $Si_3N_4$. On the insulating layer 2 is a section electrode 3 (as a gate electrode or a counter electrode of the cathode 9) made of such a high-melting metal as molybdenum, tungsten, chromium, and tungsten silicide ($WSi_x$). The second electrode 3 is covered with a highly conductive, corrosion resistant metal protective layer 13 made of gold or platinum. This metal protective layer 13 constitutes the feature of the present invention.

EXAMPLE 2

Figure 2:
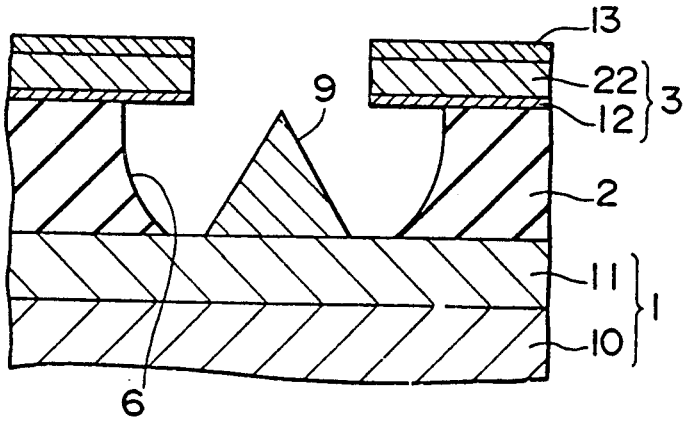
FIG. 2 is a schematic enlarged sectional view showing another embodiment of an array of field emission cathodes pertaining to the present invention.

Another embodiment of the present invention is explained with reference to FIG. 2, in which there is shown a base 1 which is composed of a glass substrate 10 and a first electrode 11 in the form of a conductive layer of aluminum or chromium. (In FIGS. 1 and 2, like reference characters designate like or corresponding parts.). In this embodiment, the second electrode 3 is composed of a layer 12 of polycrystalline silicon and a layer 22 of a high-melting metal such as W, $WSi_x$, $MoSi_x$, and $TiSi_x$. The second electrode 3 is covered with a protective layer 13 of highly conductive, corrosion resistant metal such as gold or platinum.

The array of field emission cathodes as mentioned in Example 1 above is produced by a process which is explained below with reference to FIGS. 3A to 3D.

Figure 3A:
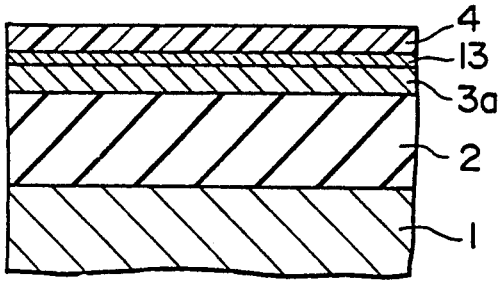
FIGS. 3A to 3D are a schematic sectional view showing an embodiment of the process for producing an array of field emission cathodes pertaining to the present invention.

As shown in FIG. 3A, the process with forming on the entire surface of a silicon substrate 1 consecutively an insulating layer 2 (1–1.5 μm thick) of $SiO_2$or $Si_3N_4$ by CVD, a metal layer 3*a* (in thickness of the order of thousands of angstroms, say 4000 Å) of molybdenum or the like, a protective metal layer 13 (in thickness of the order of tens of thousands of angstroms, say 100 Å). by vacuum deposition or sputtering, and a resist 4 by coating.

Figure 3B:
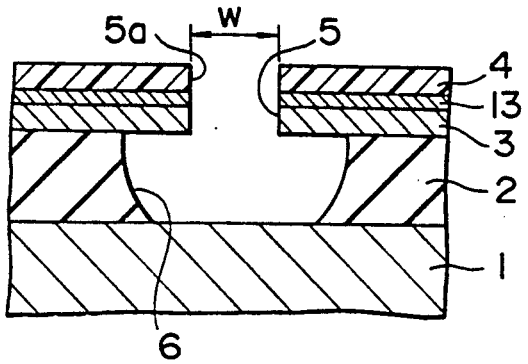

As shown in FIG. 3B, the resist 4 is subsequently exposed and developed by photolithography to form an opening 5*a*, about 1 μm in diameter (indicated by w). The protective metal layer 13 and the metal layer 3*a* undergo anisotropic etching through the opening 5*a* by RIE (reaction ion etching) to form an opening 5 of the same diameter as the opening 5*a*. Thus there is formed a second electrode 3 which is coated with the protective layer 13. The insulating layer 2 undergoes over-etching through the opening 5 to form a cavity 6. This over-etching is carried out such that the periphery of the opening 5 of the second electrode 3 projects from the inside wall of the cavity 6 in the insulating layer 2.

Figure 3C:
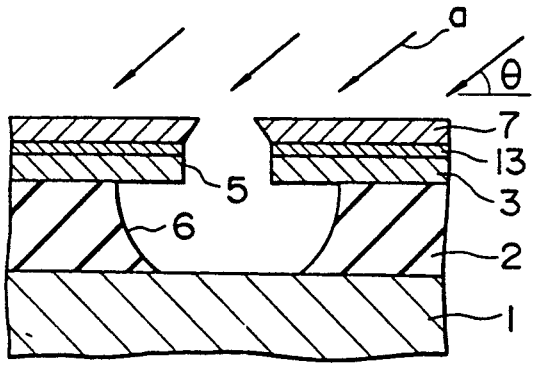

As shown in FIG. 3C, the protective metal layer 13 is coated with an intermediate layer 7 by oblique deposition in the direction of arrow a (at such an angle as to avoid deposition in the cavity 6), with the substrate 1 turning. This intermediate layer 7 is made of aluminum or nickel, which can be removed later by etching. The angle of oblique etching should be 5°–20° with respect to the surface of the substrate 1. The oblique deposition takes place such that the intermediate layer 7 has an opening which is smaller than the opening 5.

Figure 3D:
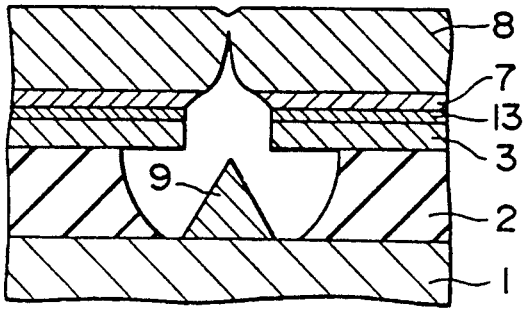

As shown in FIG. 3D, a material layer 8 of molybdenum or the like is deposited over the entire surface by vertical deposition so as to form a conical cathode 9 in the cavity 6. (Since the opening in the intermediate layer 7 is smaller than the opening 5 on account of the oblique deposition, the opening of the material layer 8 becomes smaller as the deposition proceeds. This makes the cathode 9 being formed on the substrate by deposition through the opening 5 become tapered off with time.)

Finally, the material layer 8 is removed by lift-off as the intermediate layer 7 is removed by etching with a sodium hydroxide solution which dissolves the intermediate layer 7 alone. Thus there is obtained a field emission cathode as shown in FIG. 1. The intermediate layer 7, which is made of aluminum, is easily separated from the protective metal layer 13, which is made of gold. Therefore, the material layer 9 formed on the intermediate layer 7 is removed with certainty.

The thus formed field emission cathode emits electrons upon application of a voltage of about $10^6$ V/cm or above across the cathode 9 and the second electrode 3, with the cathode 9 unheated. This kind of minute field emission cathode can operate at a comparatively low voltage, with the gate voltage being of the order of tens of hundreds of volts, because the conical cathode 9 is about 1.5 μm in diameter and several thousand angstroms in height.

The field emission cathode pertaining to the present invention is characterized by that the second electrode 3 made of molybdenum, tungsten, or chromium is covered with the protective metal layer 13 of gold. Therefore, the second electrode 3 has improved oxidation resistance and chemical resistance which prevent it from fluctuating and decreasing in electrical conductivity. This is the reason why the field emission cathode emits electrons stably at a low gate voltage of the order of tens to hundreds of volts.

In addition, the protective metal layer 13 made of a highly conductive material improves the electrical conductivity of the second electrode 3 (as the gate electrode). This permits the field emission cathode to emit electrons stably even when it experiences overcurrent. Moreover, the protective metal layer 13 protects the second electrode 3 (as the gate electrode) from being damaged by reflected electrons or secondary electrons from a fluorescent material. Therefore, this field emission cathode has a long life.

In the foregoing example, the field emission cathode has the cathode 9 in the form of cone. However, the cathode 9 may take on a pyramid shape or a ridge having a triangular section and extending in the direction perpendicular to the paper in which FIGS. 1 and 2 are drawn. The cathode 9 may take on any other shape.

In the foregoing examples, the protective metal layer 13 and the second electrode 3 are formed simultaneously. Alternatively, the protective metal layer 13 may be formed by oblique deposition after the removal of the intermediate layer 7 and the material layer 8 from the second electrode 3. In this case, the angle of oblique deposition should be properly selected so as to avoid deposition in the cavity 6.

An array of field emission cathodes pertaining to the present invention may be produced by the process disclosed in Japanese Patent Laid-open No. 160740/1981 (mentioned above), which involves the crystallographic etching for a single crystal substrate. In this case, too, it is possible to form the protective metal layer 13 simultaneously with the second electrode 3 or by deposition in the last step.

An array of field emission cathodes produced as mentioned above is applied to a flat display as explained below with reference to FIGS. 4 and 5.

Figure 4:
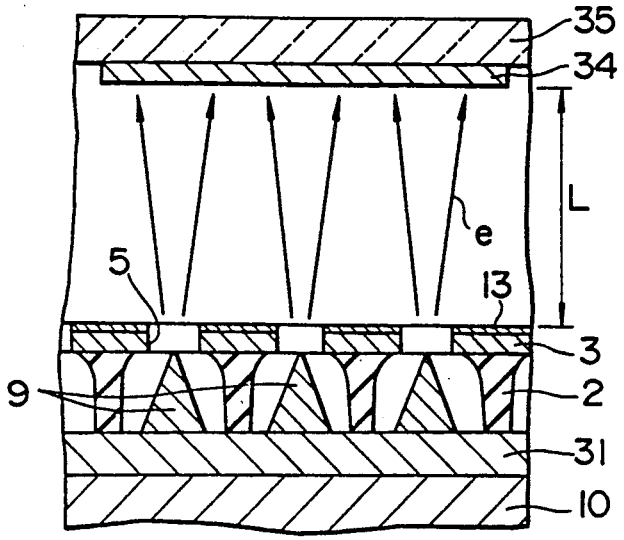
FIG. 4 is a schematic enlarged sectional view showing an embodiment of an array of field emission cathodes.

FIG. 4 is a schematic enlarged sectional view showing a flat display in which the field emission cathodes pertaining to the present invention are used as electron guns. Referring to FIG. 4, there is shown a substrate 10. On the substrate 10 is a conductive layer 31 of aluminum or chromium, which functions as a first electrode. On the conductive layer 31 are sharply pointed conical cathodes 9 made of tungsten or molybdenum having a high melting point and a high work function. The conical cathodes 9 are arranged at intervals of, say, 10 μm, and are surrounded by an insulating layer 2 of $SiO_2$. On the insulating layer 2 is a second electrode 3 of a high-melting metal (such as molybdenum, tungsten, and chromium). On the second electrode 3 is a protective metal layer 13 of gold or platinum having high conductivity and good corrosion resistance. The second electrode 3 functions as the gate 33 for the cathodes 9. Opposite to the cathodes 9 is placed a glass plate 35 coated inside with a fluorescent material 34, so that electrons emitted by the cathodes 9 impinge upon the fluorescent material 34 through the openings 5 formed in the gate 33, as indicated by arrows e. Incidentally, the fluorescent material 34 is several millimeters away from the protective metal layer 13, as indicated by L.

Figure 5:
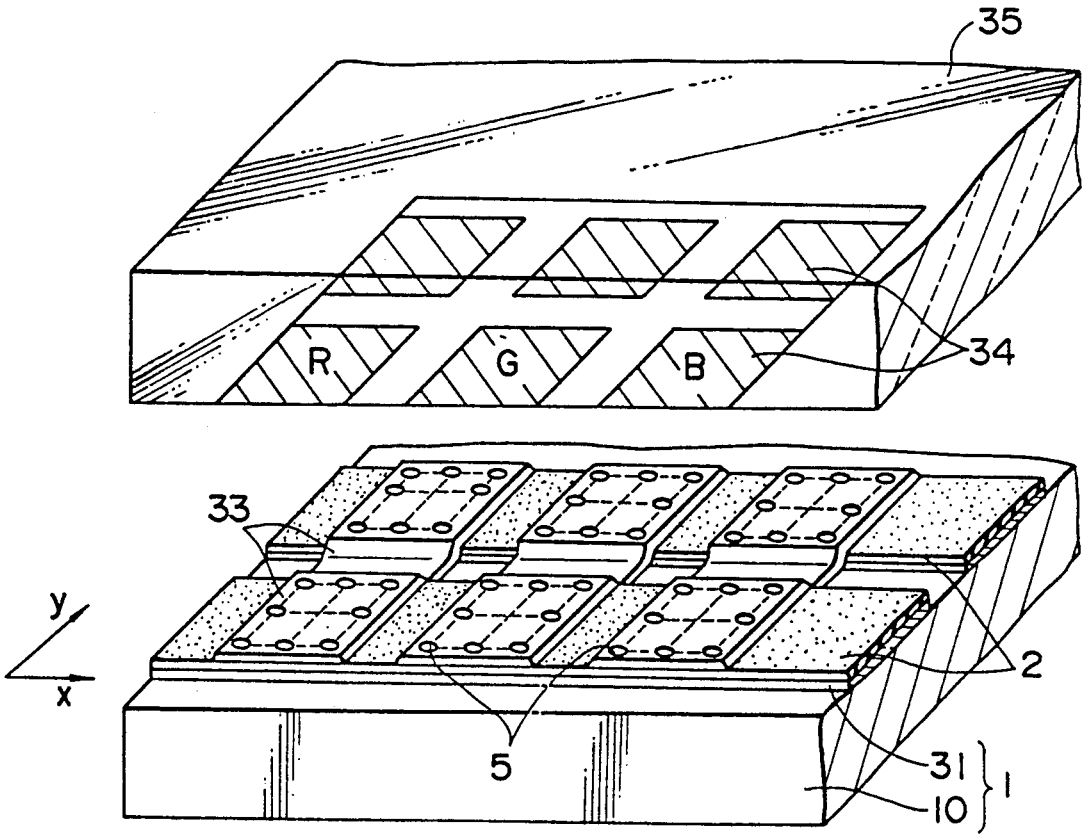
FIG. 5 is a schematic cut-away perspective view showing an embodiment of a flat display unit.

A large number of the field emission cathodes as mentioned above may be arranged in array to form a flat display unit as shown in FIG. 5, which is a schematic cutaway perspective view. Referring to FIG. 5, there is shown a base 1 composed of a glass substrate 10 and an aluminum conductive layer 31 which is a narrow strip extending in the direction indicated by an arrow x. On the aluminum conductive layer 31 is an insulating layer 2. On the insulating layer 2 is a gate 33 composed of a second electrode 3 and a protective layer 13. The gate 33 is a narrow strip extending in the direction indicated by an arrow y. (The directions x and y are perpendicular to each other.) The conductive layer 31 and the gate 33 intersect each other to form a square region. On this square region are arranged cathodes (not shown) at intervals of 10 μm, said cathodes being formed in an insulating layer 2 having respective cavities and openings 6.

Opposite to each square region is one of red (R), green (G), and blue (B) fluorescent materials 34 which are arranged sequentially. The fluorescent materials 34 coat a glass plate 35, with a transparent conductive layer of ITO (complex oxide of indium and tin) interposed between them. The glass plate 35 is joined to the base 1, with a spacer (several millimeter thick) interposed between them, and the space enclosed by them is evacuated to about $10^{-6}$ Torr and hermetically sealed.

To operate the flat display unit constructed as mentioned above, a comparatively low voltage from tens to hundreds of volts (say, 100 V) is applied across the conductive layer 31 (extending in the direction x) and the gate 33 (extending in the direction y), and simultaneously an acceleration voltage (about 500 V) is applied across the gate 33 and the ITO conductive layer adjacent to the fluorescent material 34. Upon voltage application, the cathodes emit electrons to cause the opposite fluorescent material 34 to glow. In this way, the flat display unit operates with a low voltage and hence a low power consumption.

The above-mentioned display unit may be modified such that the fluorescent material 34 is about 30 mm away from the gate 33. In such a case, the acceleration voltage should be raised to about 3 kV so that the cathodes 9 emit electrons to cause each of the fluorescent materials 34 to glow. There is another possible modification in which the glass plate 35 is directly coated with the fluorescent material 34, which is further coated with a thin aluminum layer. In this case, it is necessary to apply an acceleration voltage across the metal layer and the gate 33 which is higher than that specified above.

As mentioned above, the field emission cathodes pertaining to the present invention may be used as electron guns for a flat display unit. In this case, they emit electrons stably without being affected by scattered reflected electrons and secondary electrons. Moreover, the flat display unit has a long life because the electron guns remain stable on account of the gate 33 covered with an oxidation-resistant surface.

EXAMPLE 3

Figure 6:
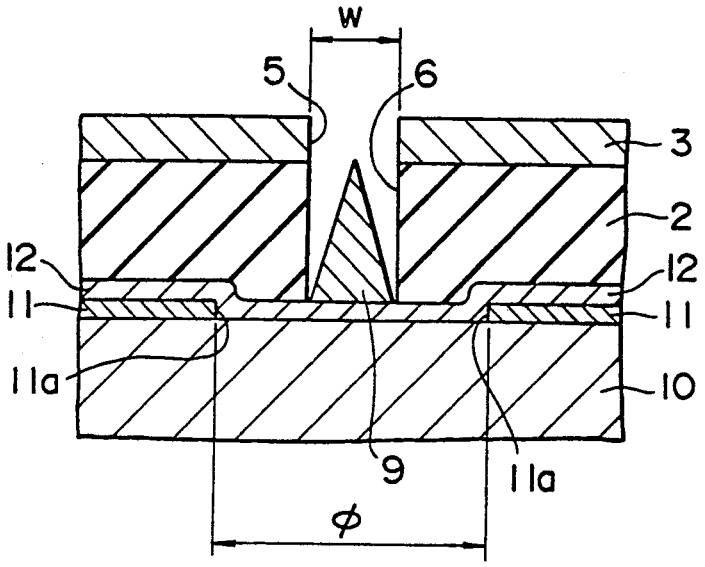
FIG. 6 is a schematic enlarged sectional view showing an embodiment of an array of field emission cathodes pertaining to the present invention.
Figure 7:
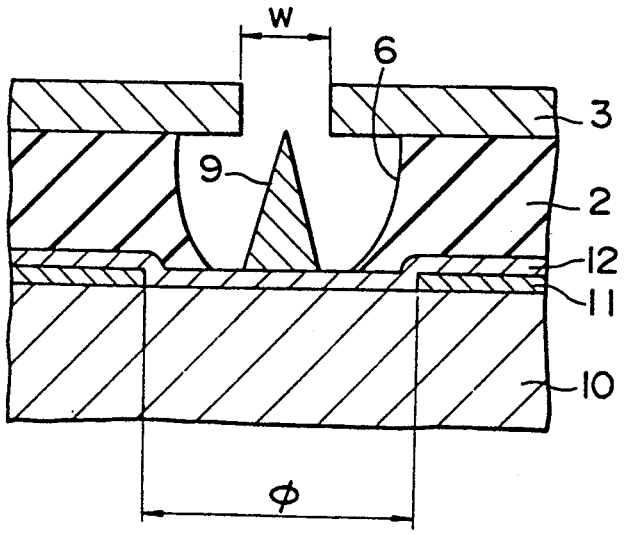
FIG. 7 is a schematic enlarged sectional view showing another embodiment of an array of field emission cathodes pertaining to the present invention.

Another embodiment of the present invention is explained with reference to FIGS. 6 to 10. Referring to FIG. 6, there is shown an insulating substrate 10 made of glass of the like. On the insulating substrate 10 is a first electrode 11 which has a circular opening 11*a* (several to 10 μm in diameter). On the first electrode 11 is a resistance layer 12 of silicon having a thickness from tens of angstroms to several microns and a resistance of the order of hundreds to millions of Ω.cm. On the resistance layer 12 above the opening 11*a* of the first electrode 11 is formed a sharply pointed conical cathode 9 made of such a metal as tungsten and molybdenum, which has a high melting point and a low work function. Around the conical cathode 9 is an insulating layer 2 of $SiO_2$ or the like, which has a cavity 6 with an opening 1–1.5 μm in diameter (indicated by w). On the insulating layer 2 is a second electrode 3 (as a gate electrode or a counter electrode of the cathode 9) made of such a high-melting metal as molybdenum, tungsten, niobium, and tungsten silicide ($WSi_x$).

The array of field emission cathodes as mentioned above is produced in the following manner. First, an insulating substrate 10 of glass or the like is coated with a metal layer of aluminum or the like by vacuum deposition or sputtering. In the metal layer is formed a circular opening 11*a* several μm to 10 μm (say, 10 μm) in diameter by photolithography. Thus the metal layer functions as a first electrode 11 (or base electrode). The first electrode 11 (and the substrate exposed through the opening in the first electrode 11) are coated with a resistance layer 12 of silicon by vacuum deposition or sputtering. This resistance layer has a thickness of the order of tens of angstroms to several microns (say, 50 Å) and also has a volume resistance of the order of hundreds to millions of Ω.cm (say, 500 Ω.cm). The resistance layer is coated with an insulating layer 2 (1–1.5 μm thick) of $SiO_2$, $Si_3N_4$, or the like by CVD (chemical vapor deposition). The insulating layer 2 is coated by vacuum deposition or sputtering with a metal layer of tungsten, molybdenum, niobium, tungsten silicide ($WSi_x$), or the like (having a thickness of the order of thousands of angstroms, say, 4000 Å). In the metal layer is formed by photolithography a circular opening 5 about 1 μm in diameter (indicated by w), which is just above the first electrode 11 (that is, the center of the opening 5 coincides with the center of the opening 11*a*). Thus the metal layer functions as a second electrode 3 (or gate electrode). The insulating layer 2 undergoes anisotropic etching by RIE through the opening 5 so as to form a cavity 6. On the second electrode is formed a peelable layer from aluminum or the like which can be easily removed by etching in the subsequent step to remove the layer of the cathode material mentioned later. This peelable layer is formed by oblique deposition at an angle of 5°–20° to avoid deposition in the cavity 6, with the substrate 10 turning. The peelable layer is coated by vertical deposition with such a material as tungsten and molybdenum which has a high melting point and a low work function. This material deposits on the resistance layer 12 through the opening 5 to form the cathode 9. (Since the opening in the peelable layer is smaller than the opening 5 on account of the oblique deposition, the opening of the material layer becomes smaller as the deposition proceeds. This makes the cathode 9 being deposited through the opening 5 become tapered off with time.) Finally, the material layer is removed by lift-off as the peelable layer is removed by etching with a sodium hydroxide solution which dissolves the peelable layer alone. In this way, there is obtained a field emission cathode as shown in FIG. 6.

According to an alternative process, the cavity 6 is formed by isotropic etching through the circular opening in the second electrode 3. In this case, the overetching of the insulating layer 2 causes the periphery of the opening 5 of the second electrode 3 to project from the inside wall of the cavity 6 in the insulating layer 2.

The field emission cathodes constructed as mentioned above are not seriously damaged by dust coming into contact with them. This is explained below with reference to FIGS. 8 to 10.

Figure 8:
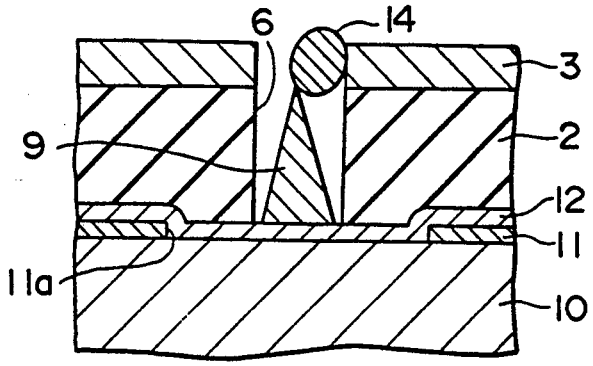
FIG. 8 is a schematic enlarged sectional view showing an embodiment of an array of field emission cathodes pertaining to the present invention.

In the case of the field emission cathode shown in FIG. 8, which has the resistance layer 12 between the cathode 9 and the first electrode 11, there is no fear of short circuit between the first electrode 11 and the second electrode 3, even when an electrically conductive particle of dust gets in between the second electrode 3 and the tip of the cathode 9. Other cathodes remain unaffected.

Figure 9:
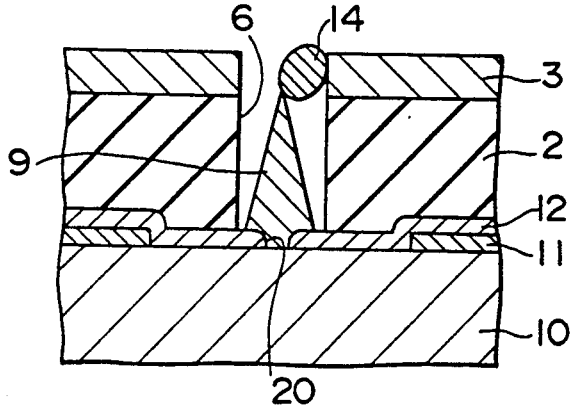
FIG. 9 is a schematic enlarged sectional view showing an embodiment of an array of field emission cathodes pertaining to the present invention.

In the case of the field emission cathodes shown in FIG. 9, which does not have the first electrode 11 under the cathode 9 but defectively has a pinhole 20 through which the bottom of the cathode 9 is in contact with the substrate, there is no fear of short circuit between the first electrode 11 and the second electrode 3, even when an electrically conductive particle of dust gets in between the second electrode 3 and the tip of the cathode 9. Other cathodes remain unaffected.

Figure 10:
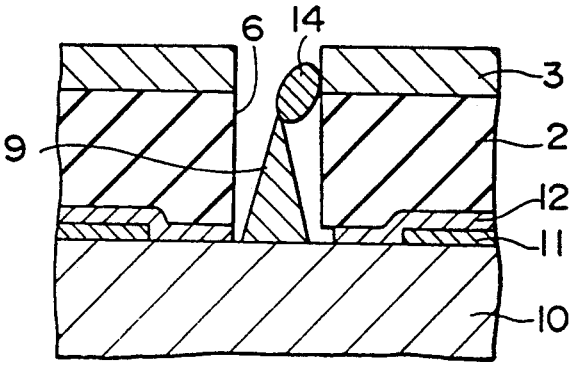
FIG. 10 is a schematic enlarged sectional view showing an embodiment of an array of field emission cathodes pertaining to the present invention.
Figure 11:
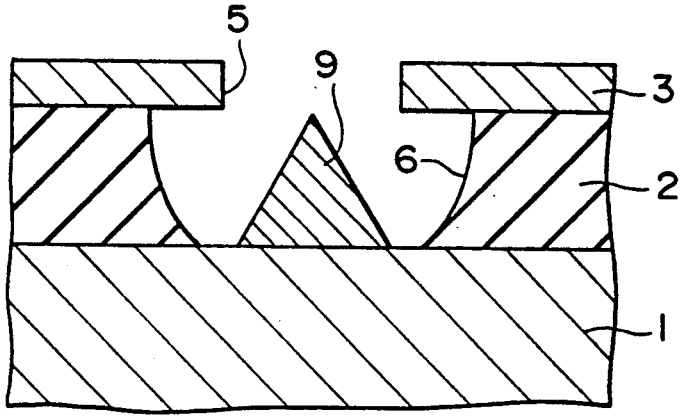
FIG. 11 PRIOR ART
FIG. 11 is a schematic enlarged sectional view showing an example of an array of field emission cathodes of prior art technology.
Figure 12:
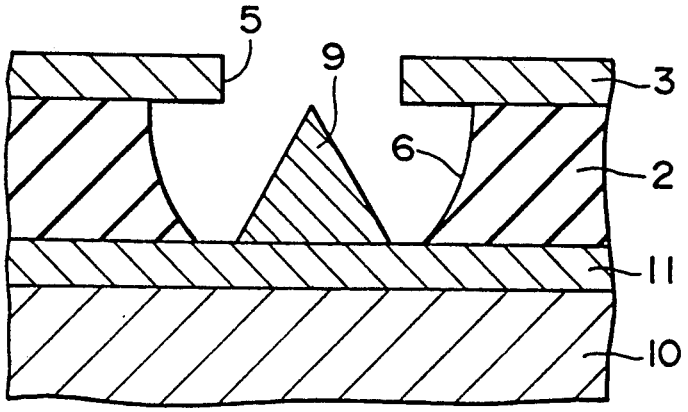
FIG. 12 PRIOR ART
FIG. 12 is a schematic enlarge sectional view showing an example of an array of field emission cathodes of prior art technology.
Figure 13A:
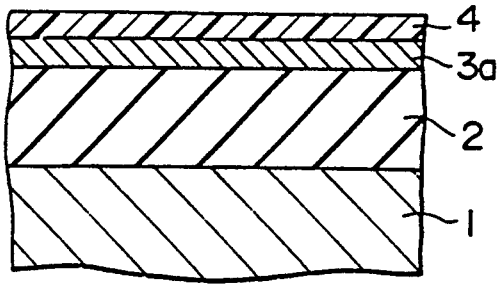
FIG. 13A PRIOR ART
FIGS. 13A to 13D are a schematic sectional view showing an example of the process for producing an array of field emission cathodes of prior art technology.
Figure 13B:
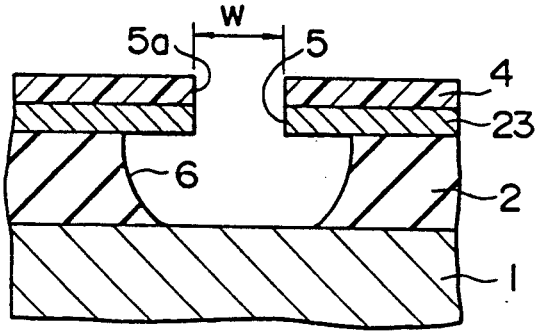
FIG. 13B PRIOR ART
Figure 13C:
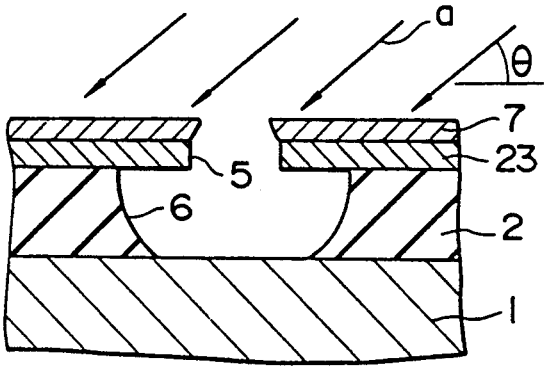
FIG. 13C PRIOR ART
Figure 13D:
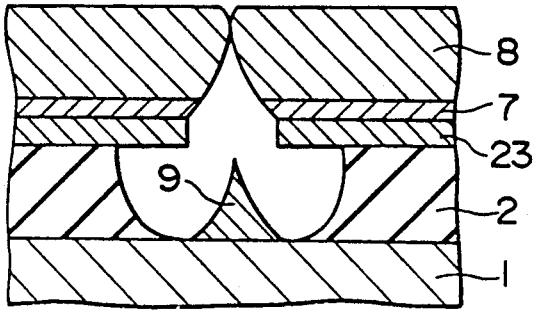
FIG. 13D PRIOR ART
Figure 14:
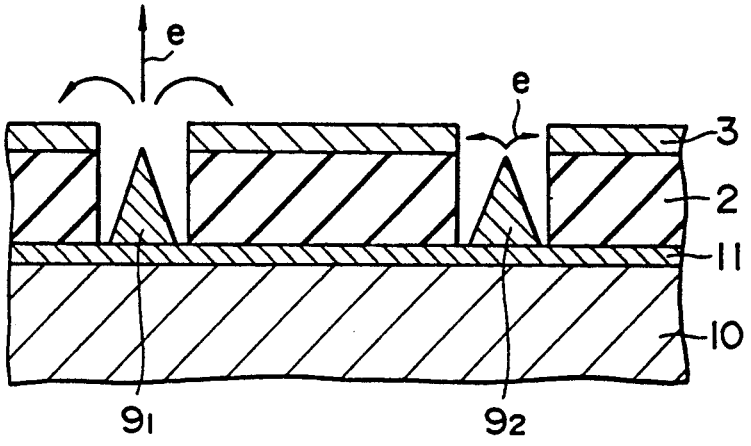
FIG. 14 PRIOR ART
FIG. 14 is a schematic enlarged sectional view showing an example of an array of field emission cathodes of prior art technology.
Figure 15:
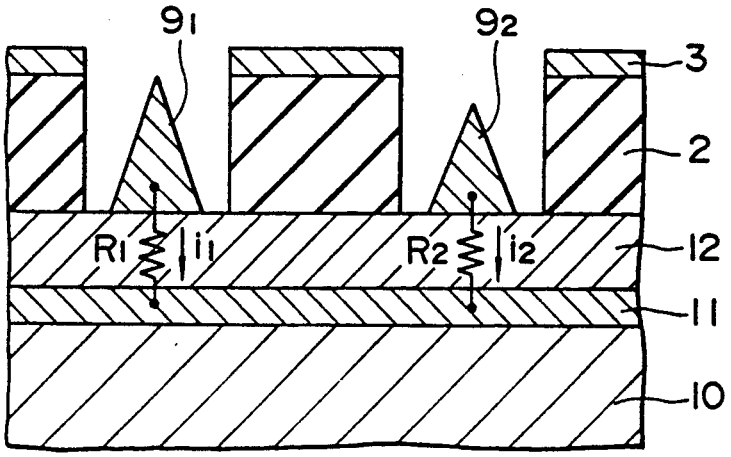
FIG. 15 PRIOR ART
FIG. 15 is a schematic enlarged sectional view showing an example of an array of field emission cathodes of prior art technology.
Figure 16:
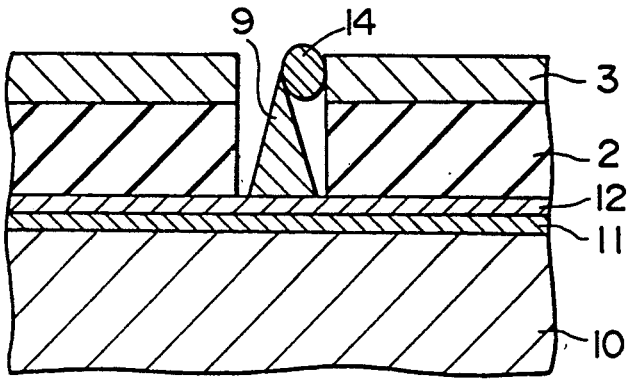
FIG. 16 PRIOR ART
FIG. 16 is a schematic enlarged sectional view showing an example of an array of field emission cathodes of prior art technology.
Figure 17:
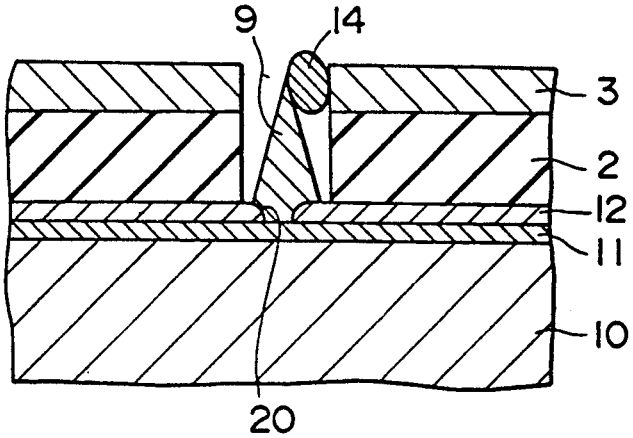
FIG. 17 PRIOR ART
FIG. 17 is a schematic enlarged sectional view showing an example of an array of field emission cathodes of prior art technology.

In the case of the field emission cathodes shown in FIG. 10, which defectively has the resistance layer 12 partly uncoated in the cavity 6 so that the cathode 9 is in direct contact with the substrate 10, there is no fear of short circuit between the first electrode 11 and the second electrode 3, even when an electrically conductive particle of dust gets in between the second electrode 3 and the tip of the cathode 9. Other cathodes remain unaffected.

As explained above with reference to FIGS. 8 to 10, the field emission cathodes pertaining to the present invention offer an advantage of being completely free from short circuits between the first electrode 11 and the second electrode 3. The presence of some pinholes 20 as shown in FIG. 9 and the partial absence of the resistance layer 12 as shown in FIG. 10 are inevitable in the production of hundreds of millions of field emission cathodes arranged at intervals of about 10 μm for use as electron guns of a flat display unit. Even such defective field emission cathodes are completely free from short circuits between the first electrode 11 and the second electrode 3. Even though some of the cathodes become inoperative due to dust sticking to them, other cathodes remain normal and hence permit the application of a prescribed voltage. This advantage leads to improved production yields.

Incidentally, in the above-mentioned examples, it is desirable that the cathode 9 be as close to the first electrode 11 as possible so as to avoid voltage drop and to prevent the resistance layer 12 from getting hot when a gate voltage is applied across the cathode 9 and the second electrode 3 through the resistance layer 12. It follows, therefore, that the opening 11*a* should be several μm to 10 μm in diameter.

The foregoing embodiments may be modified in several ways. For example, the opening 5 of the second electrode 3 may be square instead of circular and the cathode 9 may be pyramid instead of conical. Alternatively, the opening 5 may be in the form of slot (extending in the direction perpendicular to paper) instead of a circular hole and the cathode 9 may be in the form of ridge (extending in the direction perpendicular to paper) instead of a circular cone. The opening 11*a* of the first electrode 11 may be square instead of circular. It is possible to form a single opening 11*a* for a plurality of cathodes 9 instead of forming an opening 11*a* for each cathode 9. In this case, the hole 11*a* should be formed such that its periphery is several μm away from the individual cathodes 9.

In the foregoing embodiments, the resistance layer 12 is made of silicon; but silicon may be replaced by any other semiconductor having a volume resistance of the order of hundreds to millions of Ω.cm. The resistance layer 12 permits the applied voltage to be controlled according to the current which increases or decreases. This prevents the uneven emission of electrons which results from the variation of the cathode shape and also permits the substantially uniform electron emission.

What is claimed is:

1. An array of field emission cathodes of the type, in which each element is made up of a substrate which serves as a first electrode, an insulating layer having a cavity formed therein, a cathode formed on the first electrode and in the cavity, and a second planar electrode formed on the insulating layer and said second electrode made of two layers comprising a high melting metal layer and a silicon layer, wherein the second electrode is coated with a protective metal layer having good conductivity and corrosion resistance on its planar surface which is furthest from said substrate.

2. An array of field emission cathodes which comprises a first electrode to apply voltage to a plurality of cathodes, a resistance layer, an insulating layer, and a second electrode which are formed on top of each other, said second electrode and said insulating layer having a cavity therein, said cathode being formed in said cavity and on said resistance layer, and said first electrode having a void under the cathode so that said first electrode cannot make direct electrical contact with said cathode through said resistance layer.

* * * * *